United States Patent [19]

Gollahon

[11] Patent Number: 4,830,071

[45] Date of Patent: May 16, 1989

[54] WOOD PROCESSING MACHINE

[76] Inventor: Robert J. Gollahon, 1568 Spring Hill Rd., Suite 401, McLean, Va. 22102

[21] Appl. No.: 171,596

[22] Filed: Mar. 22, 1988

[51] Int. Cl.[4] ..... B27L 7/00; B26F 1/14

[52] U.S. Cl. ..... 144/193 A; 83/133; 144/193 E; 144/366

[58] Field of Search ..... 144/193 R, 193 A, 193 E, 144/193 K, 366; 83/133

[56] References Cited

U.S. PATENT DOCUMENTS

| | | | |
|---|---|---|---|
| 2,514,915 | 7/1950 | Von Der Werth . | |
| 3,802,473 | 4/1974 | Carr . | |
| 3,913,643 | 10/1975 | Lambert | 144/172 |
| 4,078,591 | 3/1978 | Syrjala et al. | 144/193 A |
| 4,104,941 | 8/1978 | Krueger | 83/133 |
| 4,353,401 | 10/1982 | Schilling . | |
| 4,388,957 | 6/1983 | Schilling . | |
| 4,434,825 | 3/1984 | Blomqvist et al. . | |
| 4,478,263 | 10/1984 | Johnston . | |

FOREIGN PATENT DOCUMENTS

| | | | |
|---|---|---|---|
| 1097193 | 3/1981 | Canada | 144/193 A |
| 729365 | 12/1964 | Italy . | |
| 414082 | 7/1974 | U.S.S.R. | 144/193 A |
| 0547345 | 4/1977 | U.S.S.R. . | |

*Primary Examiner*—W. Donald Bray

*Attorney, Agent, or Firm*—Pollock, Vande Sande & Priddy

[57] ABSTRACT

A wood stump splitting apparatus includes a splitting chamber for receiving a plurality of various sized wood stumps. The splitting chamber has one wall including a splitter grid. Press is provided for pressing the wood stumps against cutting edges of the splitter grid and pushing the plurality of wood stumps through the splitter grid apertures. Press includes a plurality of longitudinal, spaced-apart pushing members which push the stumps through grid apertures and ensure complete extrusion of wood pieces and prevent sticking of the compressed wood pieces in grid apertures.

28 Claims, 3 Drawing Sheets

WOOD PROCESSING MACHINE

BACKGROUND OF THE INVENTION

The present invention relates to wood-stump processing machines for reducing wood-stumps into a plurality of pieces by pressing them through a grid comprising a plurality of cutting plates. The reduced pieces may then be subjected to further processing, as for example, to produce wood mulch, or firewood.

In densely populated urban areas, one problem which land developers face when clearing wooded areas is to dispose of the tree stumps. A common practice at present is to collect and transport the stumps to a waste dump or land fill area. However, because the cost of land in most urban areas is so high, the use of a large amount of land as a temporary waste dump or permanent land fill necessarily results in excessive costs for stump disposal. Some appreciation of the cost involved may be gained from knowing that it is not uncommon in a large urban area to have to dispose of hundreds of truck loads of stumps each day at a cost of hundreds of dollars per truck load. The consequent high cost of disposal of the wood-stumps, i.e. transportation, labor, and equipment presents a severe economic burden. Of course, the alternative of burning the stumps is not practical because of the detrimental effects on the environment; similarly, burying the stumps is usually banned because the decay of the stumps tends to generate harmful methane gas which may adversely affect the ground water.

There is, therefore, a need for a more economical and environmentally acceptable solution to present day wood-stump disposal practices. The present invention provides such a solution since it accomplishes the effective and rapid processing, at low cost, of the wood-stumps while at the same time producing a useful by-product, thereby eliminating the adverse environmental factors. This is accomplished according to the present invention by providing a massive tree stump processing machine into which a large quantity of stumps may be placed at the same time, together with a means for pressing the stumps through a cutting grid so as to cut the stumps into a plurality of relatively small pieces which may thereafter be further reduced into still smaller pieces to generate, for example, wood mulch or firewood. Also, since the process carried out necessarily results in extreme compression of the cut pieces of wood, water and also tree sap are squeezed out of the resulting pieces, thereby resulting not only in a drier, lighter product but also providing with the collected tree sap a useful by-product.

The reducing of tree stumps presents problems which are quite different from the mere slicing of logs. Thus, the various wood-stumps are of highly irregular shape and size, and the direction of the grain of the wood within each stump is quite irregular. It is also essential to be able to process various types and sizes of wood-stumps simultaneously in a single batch. Moreover, the wood-stumps when being processed in the equipment are in their natural state, as they are collected from the land, not cleaned, debarked, or prepared in any way. It is also not feasible to orient or reposition the stumps which are loaded into the apparatus for the purpose of aligning the grain with direction of movement through the cutting grid, not only because of the labor involved in doing so but also because of the irregular nature of the grain in a stump as previously mentioned. It is of course apparent that a machine which is intended to press a number of tree stumps through a cutting grid must be constructed to have enormous strength, and this is particularly true of the cutting grid itself. The apertured cutting grid must be provided on each of its peripheral edges with a cutting edge; but clearly, considering the forces which must of necessity be applied by such cutting edges, they cannot be of razor-like thinness. Typically, the minimum width of the cutting edge is in the order of one-quarter of an inch. Such a cutting edge must of necessity be able to resist extremely large forces in the stump cutting operation, and this means that the cutting edge must be supported on a member of great strength and correspondingly large thickness, typically in the order of 3 inches, and with a depth in the direction of stump movement of about 24 inches.

It follows from these requirements that the aperture must define an opening that is significantly smaller in area that the area circumscribed by the cutting edges surrounding any aperture in the grid, and the consequence of this is that the section of the stump that is extrude through each aperture necessarily becomes considerably compressed in its cross-section. In turn, a consequence of this compression is that the stump section that is forced through each section of the grid tends to be tightly wedged within the aperture; therefore, at the conclusion of each extrusion operation, there is a tendency for a number of the stump sections to clog the cutting grid and extend at varying lengths below the grid, thereby making it difficult, and at times impossible, for the comminuted stump sections below the grid to be removed since the presence of the underhanging sections interferes with the operation of removal equipment, such as a railed cart for example. It is accordingly an important feature of the invention that the means which forces the stump through the cutting grid has the capability of completely forcing each of the individual stump sections entirely through the apertures in the grid.

Wood processing machines for press splitting wood logs into individual pieces are known in the art, for example from U.S. Pat. No. 4,478,203 or Canadian Pat. No. 1,097,197. Both patents however relate to machines and processes for splitting a single log into a plurality of individual pieces by pressing the log through a cutting grid. The log is first debarked and precut to a specific (length) thickness. The splitting is then performed in such a manner that it occurs substantially along the grain of the wood. This necessarily requires that each log be oriented in such a way in the equipment that the cutting can occur along the length of the grain; this is clearly not practical for reducing tree stumps for reasons described above.

In log splitting machines known in the prior art, each log loaded into the splitting chamber pushes the previous log through the grid apertures to complete extrusion of the wood pieces from the cutting grid apertures. Such prior art wood processing machines are not suitable for processing of a plurality of wood-stumps of differing wood species and sizes as also described above. Therefore, the problems which must be solved in a method and apparatus for cutting/splitting of wood-stumps present different tasks than the compression-splitting of wood-logs.

SUMMARY OF THE INVENTION

It is a purpose of the present invention to provide a solution to wood-stump disposal problems.

It is a purpose of the present invent to provide effective means for processing wood-stumps so that they may be used as a viable end product in the wood industry.

It is the main object of the present invention to provide an efficient means for the reduction of a plurality of wood-stumps of differing wood species and various shapes and sizes by pressing the wood-stumps through a cutting grid and extruding a plurality of wood pieces from the wood-stumps through the grid apertures.

It is another object of the present invention to provide a wood-stump press for reducing wood-stumps which press has a simple construction and which can be easily operated, can effectively process stumps in a batch manner, and can be economically and easily maintained.

It is still another object of the present invention to provide a machine which allows reduction of wood-stumps by pressing the stumps through a cutting grid which includes means for eliminating stump sections sticking in the cutting grid apertures (cells), to ensure extrusion and complete exiting of such sections from the cutting grid apertures (cells) and clearing of the grid apertures during each operating cycle.

The method of the present invention provides for the high speed, economical processing of wood stumps resulting in a large output of end product due to the continuous operation of the machine, the high speed at which it can be operated, and the simplicity of operation.

In the present inventive machine, a plurality of wood-stumps of various dimensions, species, and weight can be brought to the machine site, loaded into the wood processing apparatus without any prior preparation steps and processed continuously at high speed.

To this end, a wood stump splitting apparatus according to the present invention includes a splitting chamber having means for receiving a plurality of various sized wood stumps. The splitting chamber has one wall which includes a splitter grid. Press means are provided for pressing the wood-stumps against the cutting edges of the splitter grid and pushing the plurality of wood stumps through the splitter grid apertures (cells).

The splitter grid is designed to accomplish splitting-/cutting and extrusion of a plurality of wood pieces from the wood-stumps. It includes a plurality of longitudinal, spaced-apart pushing members which push the wood stumps to be cut and extruded through the grid apertures. The pushing members have lengths adapted to fully extend through the respective apertures of the splitter grid to ensure complete extrusion of the wood pieces and prevent sticking of the compressed wood pieces in the grid apertures (cells). When the press means reach their lowermost compressive position, the pushing members urge the compressed wood pieces through the apertures of the grid cells and thereby force them to exit by falling out of the opposite ends of the cells, thereby cleaning the apertures.

According t one preferred embodiment of the present, each cell of the splitter grid has walls formed by intersecting cutting blades. Each cutting blade has a substantially wedge-shaped top portion and a substantially rectangular bottom portion in vertical cross-section. The cutting edges of the top portions of the intersecting blades form the cutting sections of each of the grid cells. The wedge-shaped top portions form an extrusion section and the bottom portions form the support section of each cell.

Due to the wedged-shape of the top portions, the horizontal cross-section of the cutting section is larger than those of the extrusion and supporting sections. The angle of the wedge is so selected to provide a strong grid structure allowing effective cutting and on the other hand Withstanding the significant pressures involved in the splitting/cutting operation and prevent buckling or collapse of the cutting grid. The grid cutting structure of the present invention apparatus is capable of withstanding the high pressure involved when the cutting grid is forced into the wood stumps.

The preferred embodiment of the apparatus of the present invention will now be described in more detail with reference being made to the accompanying drawings wherein;

DETAILED DESCRIPTION OF THE PREFERRED EMBODIMENT

Figure 2:
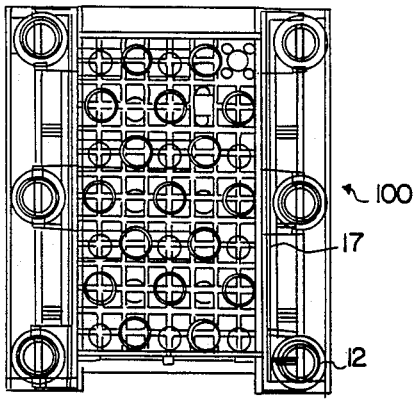
FIG. 2 shows a top view of the apparatus of FIG. 1.
Figure 3:
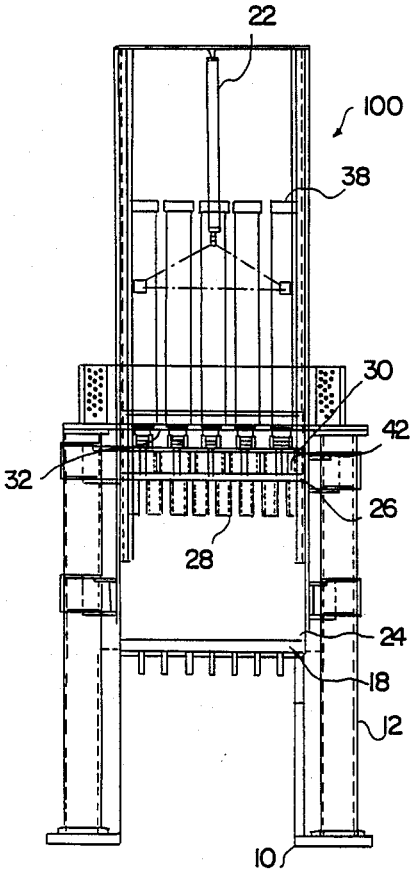
FIG. 3 shows a front view of the apparatus of FIG. 1.
Figure 1:
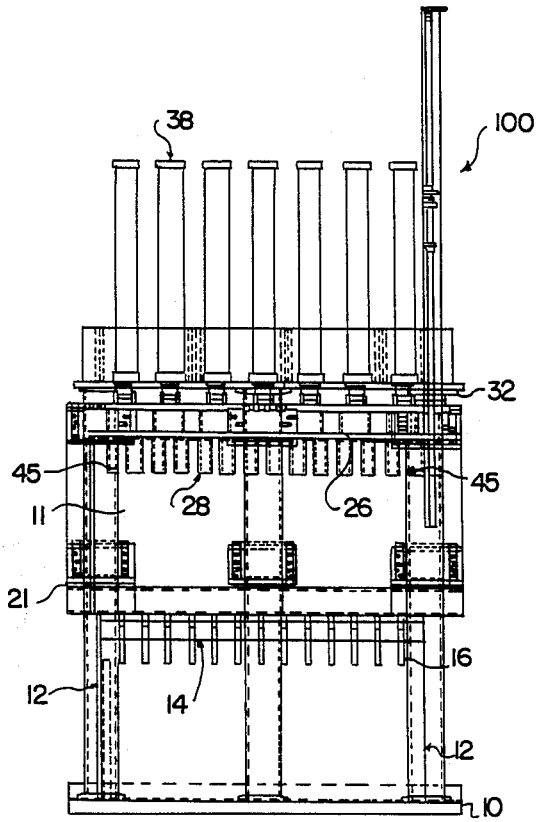
FIG. 1 shows a side view of the stump processing apparatus according to the present invention.
Figure 4:
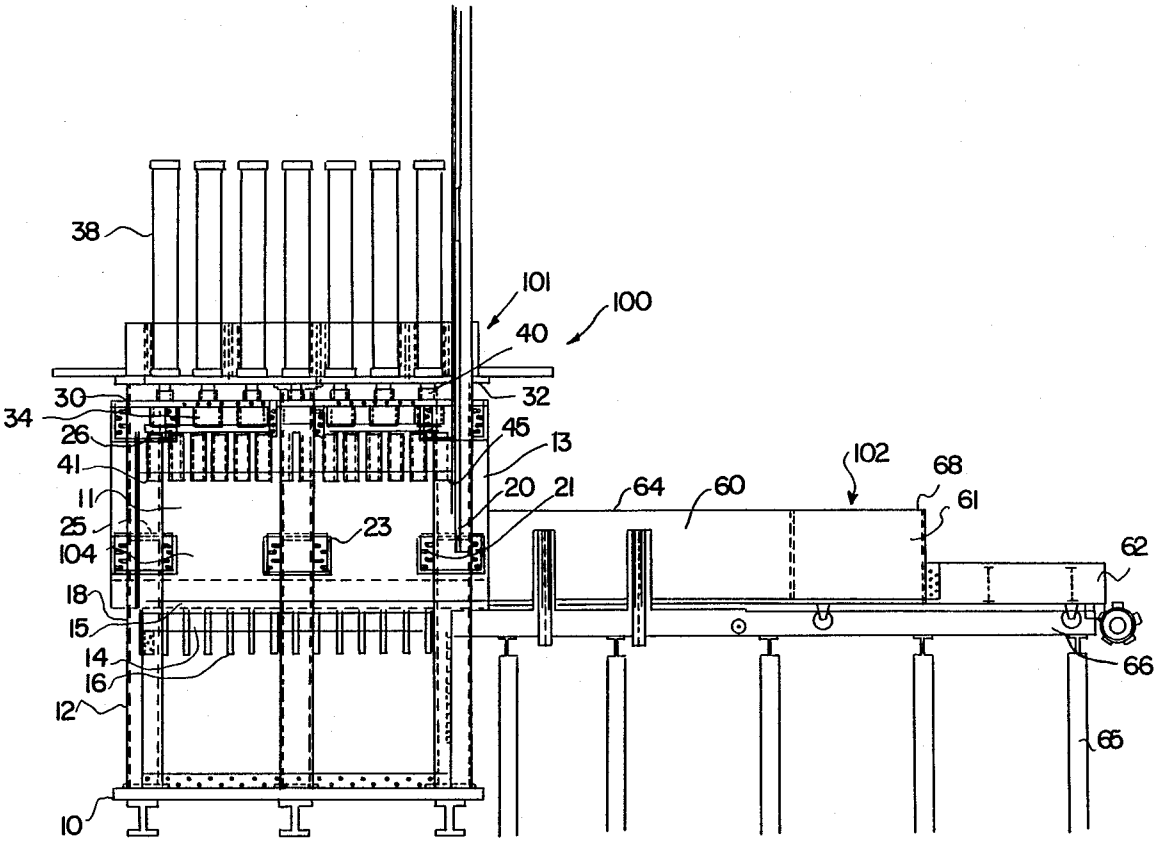
FIG. 4 shows a stump processing apparatus according to the present invention including loading means.

Referring now to FIGS. 1 through 4, the wood-stumps processing apparatus of the present machine is indicated by numeral 100 and includes a wood processing portion 101 and a loading portion 102. The wood processing portion 101 includes a support structure with a base 10 and supporting columns 12 extending upwardly therefrom. The base and the supporting columns are designed to withstand the high compression forces occurring during wood stump processing. The supporting columns support the splitting chamber 11. The splitting chamber 11 includes four side walls 13 and a bottom wall 15 constituted by a plurality of intersecting cutting blades 14,16 which form a plurality of cells 17 of the splitting grid 18, each cell defining a through aperture which is more clearly illustrated i FIG. 5 and described in greater detail below.

One of the side walls 13 of the splitting chamber 11 which faces the loading portion 102 of the wood-stumps processing apparatus 100 includes a sliding door 20 operated by a hydraulic cylinder 22 which raises and lowers the sliding door 20 to allow loading of the wood stumps into the splitting chamber 11. The splitting chamber 11 comprises a five-sided box-like structure 104. Conveniently, the structure 24 may be about 8 feet high, about 8 feet wide and about 14 feet long. The top of the box-like structure 104 of the splitting chamber 11 comprises a movable press means including flat cover plate member 26 which is substantially parallel to the bottom of the splitter grid 18 of the splitting chamber 11.

A plurality of longitudinal, spaced apart pushing members 28 are affixed to the top cover plate 26 and extend downwardly in the direction of the splitter grid bottom 18. The number of longitudinal pushing members 28 corresponds to the number of cutting grid cells 17 which form the cutting grid 18.

A second plate 30 is provided above the flat top cover plate 26 and is parallel thereto. Both plates 26 and 30 are interconnected by a plurality of spacers 34. A third fixed plate 32 is positioned above and substantially parallel to the second plate 30. The third plate 32 is stationary and fixedly attached onto the top of the supporting columns 12. A plurality of hydraulic cylinders 38 are mounted onto the top of the third plate 32. The piston portions 40 of the hydraulic cylinders 38 extend through the third plate 32 and are connected to the second plate 30. The movable box-like press member 24 is formed by first and second plates. The piston portions 40 of the hydraulic cylinders 38 are connected to the top second plate 30, and pushing members 28 mounted onto the first top cover plate 26 of the box-like press member 24 can be raised and lowered by operation of the hydraulic cylinders 38. This movable box-like member 24 during its up and down movement is guided and maintained in a level position as it slides evenly in a longitudinal direction along the supporting columns 12.

The movable box-like press member 24 is slidably attached to the supporting columns 12 by use of a large bearing housing 21 containing brass bushings which allow the box-like press member 24 to slide up and down the supporting columns 12 by means of a plurality of collars 23 and bearings 25, with two of them bring provided at each of the supporting columns 12.

The movable box-like press member 24 together with the pushing members 28 form a pressing means 42 which can be raised and lowered within the splitting chamber 11. When the pushing members 28 are lowered downwardly towards the cutting grid bottom portion the pushing members 28, at their lowermost position, will extend entirely through their respective apertures of the grid cells 17. The dimensions of the grid splitter bottom 18 of the splitting chamber are slightly smaller than those of the top, movable box-like press member 24. The box-like press member 24, when raised, is never completely removed from the splitting chamber 11.

In the preferred embodiment of the present invention, the cutting grid 18 may conveniently be formed of 112 square cutting cells 17. The top portions 50 of the four walls of the intersecting cutting blades 14,16 forming each square cell are wedge-shaped. When the press means is hydraulically pushed towards the splitting chamber bottom grid splitter 18 the pushing members 28 first press the wood stump towards the cutting blade edges to cut/split the wood-stumps and then extrude the wood pieces through the grid cells apertures. The pushing members 28 continuously press in the direction of the grid and through the respective grid cells until they are fully extended through the cutting grid cells 17 to ensure that the wood pieces extrude through the grid cells apertures and freely exit through the bottom of the cells of the grid splitter 18.

To avoid a build-up of dirt, wood or debris between the pushing members 28 an additional stripper plate 41 is affixed to the pushing members 28. The stripper plate 41 is of the same width, thickness and length as the first cover plate 26 to which the pushing members 28 are attached. The stripper plate 41 has a plurality of holes 43 therein through which the pushing members 28 extend. The four corner pushing members 28 have restraining means 45 which are welded to the bottom portion of the pushing members 28.

The stripper plate 41 can therefore float freely up and down in a longitudinal direction along the pushing members 28 between the restraining means 45 and the first top plate without falling off the bottom of the pushing members 28. The stripper plate 41 hangs freely and does not move upwardly along the pushing members 28 until the pushing members 28 begin to move through the splitter grid 17 thus leaving the stripper plate 41 to rest on the top of the cutting grid 18 while the pushing members 28 travel through the stripper plate 41 and completely through the cutting grid cells 17.

Located adjacent to the wood processing portion of the machine is the loading section 102. The loading section 102 includes a free-hanging loading carriage 60 and a wheeled movable counter-balanced portion 62 connected to the loading carriage 60. The loading carriage 60 may conveniently have dimensions of approximately 14 feet, long by 8 feet wide with side walls which are about 4 feet high. The top edges 64 of the side walls 61 may include wedge-shaped blades which can be used by the operator loading the carriage 60 to remove excess dirt from the wood stumps while loading the carriage 60. The length of the carriage 60 is approximately 29 feet. Power for forward and backward rolling movement of the loading carriage 60 on the channel 66 mounted in the supporting base 65 is supplied by hydraulic motors which are connected thereto by chain and sprocket assemblies. The front portion of the loading means, namely the carriage 60, can enter into the splitting chamber 11 through the raised sliding door 20.

After entry of the loading carriage 60 into the splitting chamber 11 is completed, the sliding door 20 may be lowered. The sliding door 20 is dimensioned to fit inside the loading carriage 60 at the point indicated as 68. The sliding door. 20 is notched on both sides so that the side walls of the loading carriage 60 will pass through the sliding door 20.

Figure 5:
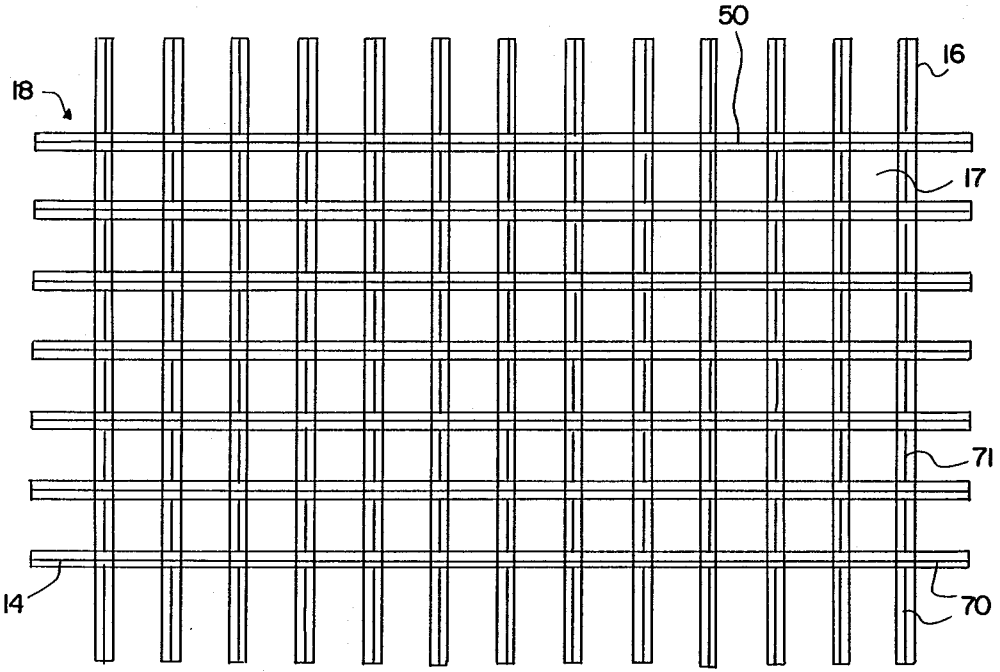
FIG. 5 shows a cutting grid design of the splitting chamber according to the preferred embodiment in enlarged detail.
Figure 6:
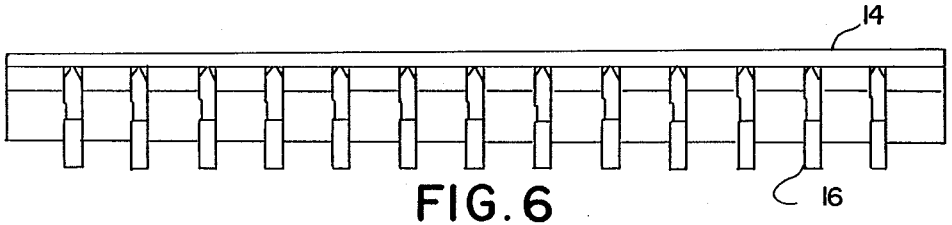
FIGS. 6 and 7 show side and front views of the splitting grid, respectively.
Figure 7:
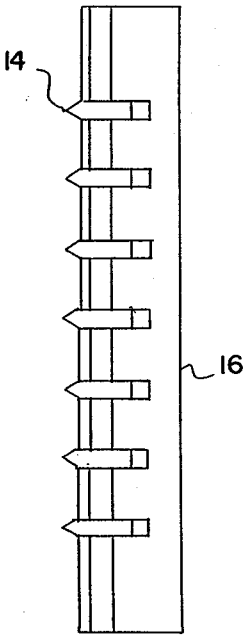

The structure of the bottom grid splitter 18 of the splitting chamber 11 will now be described in more detail with reference being made to FIGS. 5–7. FIG. 5 shows the grid-like construction of the splitting chamber bottom 18. A plurality of intersecting cutting blades 14,16 form the grid-like structure of the splitting chamber bottom 18. The longitudinal parallel blades 14 are made of a continuous single structure. A plurality of transverse blades 16 are substantially parallel to each other and perpendicular to the longitudinal blades. The walls of the transverse blades 16 have appropriate cuts so that the longitudinal blades can be fitted therein and are spot-welded. This facilitates removal and replacement of any blade in the grid structure. Such a spot-welded structure adds mechanical strength to the cutting grid. The adjacent intersecting longitudinal and transverse blades 14,16 form the square-like cells 17 of the splitter grid structure 18.

Each cell 17 of the splitter grid 18 has walls formed by intersecting cutting blades 14,16 which define a through aperture therebetween. Each cutting blade 14,16 has a substantially wedge-shaped top portion 70 and a substantially rectangular bottom portion 72 in vertical cross-section. Cutting edges 71 of top portions of the intersecting blades 14,16 form the cutting sections of each of the grid 14,16. The wedge-shaped top portions 70 form the extrusion section and the bottom portions form the support section of each cell 17. Due to the wedge-shape of the top portions, the horizontal cross-section of the cutting section is larger than those of the extrusion and supporting sections.

Figure 8:
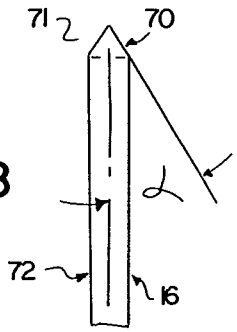
FIG. 8 is a cross-sectional view of the individual cutting blade used in the present invention cutting grid.

FIG. 8 shows a cross section of a single blade 14,16 forming the grid cell 17. In the preferred embodiment of the present invention, tee thickness of the blade may be approximately 3 inches. The cutting edge of the blade is flat and is about ¼ inch thick. The extrusion portion is wedge-shaped at an angle of about 30°. However this angle can be chosen from a range of about 25° to about 45°. The foregoing dimensions for the splitter grid blades have been determined to provide adequate strength to the grid blades so that the pressure required to force the wood through the apertures of the grid cells will not result in damage to the blades but still allow effective extrusion of the wood pieces through the grid cells.

Operation of the wood stump processing apparatus according to the present invention is as follows. Stumps, brush roots and wood debris are brought to the processing machine site. Stumps of various types and dimensions are separated from all other debris for further processing in the wood stump processing apparatus. The stumps are then loaded into the loading carriage, pressed down, and fitted to substantially fill the carriage. The top edge of the loading carriage walls includes wedge-shaped cutting blades which facilitate loading of the stumps into the loading carriage. If the stumps have too large a dirt ball to fit side-by-side in the loading carriage, the operator loading the carriage may make use of the wedge-shaped edges to remove the excess dirt during the loading operation to better fit the stumps into the loading carriage.

After completion of the loading, the carriage is moved towards the splitting chamber. The free-hanging loading carriage enters the splitting chamber and fits therein. The sliding door is then lowered and fits into the loading carriage. The loading carriage is then rolled backwardly and the sliding door acts as a stop to retain the stumps now loaded inside the splitting chamber. The bottom of the loading carriage slides under the sliding door while the two side walls of the loading carriage proceed through the notched-out portion of the sliding door.

The loading carriage returns to its original position and the loading process can then be repeated while the previous load is being processed inside the splitting chamber. The apparatus of the present invention therefore provides for a continuous uninterrupted wood-stump splitting/cutting operation with a plurality of operating cycles.

The wood stumps now inside the splitting chamber which are substantially in the same position as they were when originally loaded into the loading carriage are now ready for processing. The hydraulic cylinders press the box-like pushing means towards the load of wood-stumps.

The various stumps are split or cut by the cutting edges of the respective cells of the splitting chamber bottom grid portion into pieces. Most of the wood pieces which are split from the stumps by the cutting edges of the plurality of cutting cells are then simultaneously compressed as the pieces continue to be pressed through the wedge shaped extrusion portion of the grid cell immediately after they have passed the cutting edges. The wood pieces, most of which are approximately 12 inches square in use of the preferred embodiment, are compressed and further reduced and finally pushed through a supporting portion of grid cells apertures by the pushing members.

The dimensions of the wood pieces are thereby reduced from approximately 12 inches square to approximately 9 inches square. Therefore in the present invention method, stumps being initially split and/or cut by the cutting edges of the blades into 12 inch square pieces are immediately thereafter, compressed through the wedge-shaped extrusion portion and ultimately through the 9 inch square support portions of the grid cells. Pressing the wood pieces through the grid cells causes considerable compression and a produces a tendency for the wood pieces to remain stuck in the grid cells. Therefore it is important for the pushing members to extend through the cells apertures to push the wood pieces through the cells and clear of the apertures.

Due to the shape of the grid most of the wood pieces (except small pieces which result from the circumference of the wood-stumps) are compression extruded which eliminates about 75% of the moisture content in the extruded wood pieces. The wood product thereby obtained requires a shorter drying time for the eventual wood-products. When these products are used as firewood, an improved product results which exhibits longer burning time. The decreased moisture content of the wood pieces obtained through the process of the present invention and used in other subsequent wood processes increases their production rate in secondary grinding processes. The compression-extrusion also may provide sap by-products such as for example pine resins.

The pushing members have cross-sections corresponding substantially to the cross-section of the cutting grid cell portions. The pushing members are of such length as to extend entirely through the apertures of the grid cells in their lowermost position and provide extrusion of the wood pieces through the grid, notwithstanding its tendency to remain stuck in the grid cells because of the compression effect. The extruded output exiting the grid bottom portion of the splitting chamber includes pieces varying in dimensions from 9 inches square to smaller pieces, depending upon how the wood stump was actually centered over the square cells of the grid bottom.

Once the stumps have been completely compression-extruded through the grid cells, the hydraulic cylinders lift the movable box-like press means and pushing members upwardly from the grid bottom portion of the splitting chamber. After the top box-like press means is lifted upwardly, the sliding door, through which the loading carriage originally entered, opens and the processing apparatus is ready to accept the next wood-stump filled loading carriage.

Each operational cycle of the apparatus of the present invention, requires only a few minutes to complete loading and splitting/cutting of a plurality of wood-stumps. The operator loading the wood stumps controls the processing machine, operating it through its complete cycle automatically with uninterrupted, high-speed operation. The wood processing apparatus according to the present invention is capable of processing from 3 to stumps in one operational cycle. The cross-section of the stumps determines of course the number of stumps which can be accommodated during any one cycle.

While a particular embodiment of the present invention has been shown, it should be understood, of course, that the invention is not limited thereto, since modifications may be made, and it is contemplated to cover in the appended claims any such modification as fall within the spirit and scope of the present invention.

What is claimed is:

1. Wood processing apparatus for the reduction of wood-stumps comprising:

(a) a stump splitting chamber defining an opening for the loading into said chamber of the wood-stumps and further defining at least one wall forming a splitter grid;

(b) press means for compressively extruding the stumps through the splitter grid to thereby form wood pieces from said stumps;

(c) said splitter grid defining a plurality of through apertures and also at least one upstanding generally knife-edged cutting surface positioned to cut a stump forced thereagainst by said press means; and (d) said press means comprising a plurality of spaced-apart pressing elements each extending in the direction of motion of said press means as it forces said stumps through said apertures, the length of said pressing elements being sufficient to ensure that movement of said press means to its limiting compressive position will urge said pressing elements into said through apertures to an extent to ensure that the wood pieces extruded through such aperture will be pushed through the lower end of said apertures and thereby clear said apertures.

2. Wood processing apparatus for reduction of plurality of wood-stumps comprising:

(a) a splitting chamber for receiving the wood-stumps including a splitter grid in one wall thereof;

(b) movable press means for compressing said plurality of wood-stumps through said splitter grid apertures, said splitter grid including means for cutting and extruding a plurality of wood pieces from said wood-stumps, said press means including a plurality of spaced-apart pushing members extending in the direction of movement of said press means said pushing members being dimensioned to enter into said apertures such as to push said wood pieces through said grid to ensure extrusion of said wood pieces through said apertures and prevent retention of the compressed wood pieces in said apertures of said splitter grid.

3. Apparatus according to claim 1 or 2 wherein said apertures of said grid of said splitting chamber are defined by a plurality of cells, each cell having walls made of intersecting cutting blades, each cutting blade having a substantially wedge-shaped top portion, and a substantially rectangular bottom portion in vertical cross-section, the cutting blade edge of said top portions of said intersecting blades forming a cutting section of each of said cells, said wedge-shaped top portions forming an extrusion section of said cells and said bottom portion forming support section of said cells.

4. An apparatus according to claim 3 wherein said cutting edges of said blades are substantially flat and about ¼" wide.

5. An apparatus according to claim 3 wherein said cutting blade top portion is wedge-shaped at an angle in a range of from about 25° to about 40°.

6. An apparatus according to claim 5 wherein said angle is 30°.

7. An apparatus according to claim 3 wherein said press means comprises a cover plate which is slidable in a direction toward said splitter grid; and a plurality of longitudinal pushing members fixed to said plate and extendable downwardly toward said splitter grid cells, said members being insertable through said cells of said grid for pushing said extruded wood pieces through apertures of said splitter grid cells, wherein a cross-section of each of said members substantially corresponds to said cross-section of said supporting sections of said grid cells.

8. An apparatus according to claim 3 wherein said grid cells have a substantially square cross-section.

9. An apparatus according to claim 7 wherein said grid cells have a substantially square cross-section.

10. An apparatus according to claim 3 wherein the number of said pushing members corresponds to the number of said cells of said grid.

11. An apparatus according to claim 10 wherein said cutting section cross-section of each segment is about 25% larger than said cross-section of said supporting section.

12. An apparatus according to claim 7 further comprising a loading section with loading means including a moveable loading carriage insertable to fit into said splitting chamber and adapted to be withdrawn from said chamber with said load of wood retained in said chamber.

13. An apparatus according to claim 10 further comprising a loading section with loading means including a moveable loading carriage insertable to fit into said splitting chamber and adapted to be withdrawn from said chamber with said load of wood retained in said chamber.

14. An apparatus according to claim 13 wherein said moveable loading carriage includes a receiving container freely extending from a counter-balancing wheeled portion of said loading carriage.

15. An apparatus according to claim 14 wherein said receiving container is openable at the side facing said splitting chamber.

16. An apparatus according to claim 15 wherein said walls of said container include wedge-shaped cutting blades at the top edges for removing dirt from said wood stumps to facilitate loading of said receiving container.

17. An apparatus according to claim 14 wherein one of said side walls of said splitting chamber is slidable in a vertical direction to allow insertion of said movable container, and is dimensioned to fit inside said container after its insertion into the chamber.

18. An apparatus according to claim 17 further comprising cleaning means for preventing any dirt from packing between said pushing members after extrusion of said wood pieces through said cells.

19. An apparatus according to claim 18 wherein said cleaning means comprises a floating plate insertable onto said plurality of said longitudinal pushing members and movable between restraining means mounted at the forward ends of said longitudinal pusher members and said cover plate supporting opposite ends of said pushing members.

20. A method of reduction of a plurality of wood stumps of various sizes comprising, the steps of:

(a) pressing a plurality of stumps against a plurality of generally knife-edged cutting surfaces forming a grid by press means;

(b) cutting said stumps into a plurality of wood pieces by said cutting surfaces by forcing said stumps against said surfaces by said press means, said press means including pushing members extending in the direction of movement of said press means to ensure complete extrusion of the wood pieces through said grid.

21. A method of reducing a plurality of wood stumps of various sizes comprising the steps of:

(a) compressing said plurality of stumps in a splitting chamber through a grid-like portion of said splitting chamber by press means, including a plurality of pushing members;

(b) splitting/cutting said stump by a cutting section formed by top edges of intersecting cutting blades defining cells of said grid, and (c) continuously pressing said wood stumps with said pushing members through said cells, to effect extruding of a plurality of wobd pieces, said pushing members ensuring complete extrusion of said wood pieces from said grid cells to clear the apertures of said grid cells.

22. A method of reducing a plurality of wood-stumps of various sizes according to claim 21 wherein said pushing means includes a plate slidable in a direction towards said splitter grid and a plurality of spaced apart pushing members connected to said plate, said pushing members being dimensioned in lowermost compressing position to fully extend through apertures of said cells of said splitter grid during said pressing of said wood pieces.

23. A method according to claim 22 wherein the number of said pushing members corresponds to the number of said cells in said splitter grid.

24. A method of continuously processing a plurality of wood-stumps in a stump processing machine including a plurality of processing cycles, each cycle comprising the steps of:

(a) loading a splitting chamber with a first load of a plurality of wood stumps of various dimensions;

(b) processing said first load in said splitting chamber to obtain a plurality of wood pieces from said wood-stumps, through cutting and extruding wood-stumps through a plurality of apertures in a cutting grid of said splitting chamber;

(c) loading a second load of a plurality of wood-stumps into a loading means simultaneously with the processing of said first load; and (d) loading said second load of said wood stumps into said splitting chamber immediately after processing of said first load.

25. A method according to claim 24 wherein said processing step of each processing cycle includes:

(a) pressing said plurality of stumps in a splitting chamber towards a grid-like bottom of said splitting chamber by pressing means, including a plurality of pushing members;

(b) splitting/cutting said stumps by a cutting section formed by top edges of intersecting cutting blades constituting cells of said grid; and (c) continuously compressing said wood- stumps through said extrusion and support portions of said cells with said pushing members to effect a complete extrusion of a plurality of wood pieces from said stumps through said grid cells and thereby clearing the apertures of said grid cells.

26. A method according to claim 23 wherein said pushing means includes a plate slidable in a direction towards said splitter grid and a plurality of pushing members connected to said plate, said pushing members having length to fully extend through said apertures of said splitter grid cells in their lowermost compressing position to ensure complete extrusion of said wood pieces.

27. A method according to claim 26 wherein said loading step includes:

(a) fitting said plurality of wood-stumps into a movable loading carriage;

(b) moving said carriage to enter into said splitting chamber; and (c) withdrawing said carriage, said plurality of wood stumps being retained in substantially the same position in said chamber as in said loading carriage.

28. A method according to claim 25 wherein said processing step includes cleaning said pushing means by cleaning means provided on said pushing means to substantially remove dried dirt from said pushing means retained after said extrusion of said wood pieces.

* * * * *